US012631036B2

(12) United States Patent
Hodak

(10) Patent No.: US 12,631,036 B2
(45) Date of Patent: May 19, 2026

(54) FLEXIBLE CLOSURE FOR SWIMMING POOL SKIMMER

(71) Applicant: Michael L. Hodak, Venetia, PA (US)

(72) Inventor: Michael L. Hodak, Venetia, PA (US)

(73) Assignee: Michael L. Hodak, Venetia, PA (US)

( * ) Notice: Subject to any disclaimer, the term of this patent is extended or adjusted under 35 U.S.C. 154(b) by 469 days.

(21) Appl. No.: 18/171,691

(22) Filed: Feb. 21, 2023

(65) Prior Publication Data

US 2024/0279950 A1 Aug. 22, 2024

(51) Int. Cl.
*E04H 4/12* (2006.01)
*E04H 4/08* (2006.01)
*E04H 4/14* (2006.01)

(52) U.S. Cl.
CPC ..... *E04H 4/1272* (2013.01); *E04H 4/086* (2013.01); *E04H 4/14* (2013.01)

(58) Field of Classification Search
CPC ..... E04H 4/1272; E04H 4/086; E04H 4/14
USPC ..... 210/167.1; 4/496, 507
See application file for complete search history.

(56) References Cited

U.S. PATENT DOCUMENTS 5,551,191 A * 9/1996 Maiwandi ..... E04H 4/1254 49/465
5,937,453 A * 8/1999 Hodak ..... E04H 4/1272 4/508
10,400,505 B2 * 9/2019 Hodak ..... E06B 3/01
12,209,430 B2 * 1/2025 Hodak ..... E04H 4/14

* cited by examiner

*Primary Examiner* — Fred Prince
(74) *Attorney, Agent, or Firm* — The Webb Law Firm

(57) ABSTRACT

A sealing closure assembly for closing a skimmer opening of a swimming pool has a skimmer faceplate with a sidewall and a flange protruding from the sidewall, and a cover removably connectable to the skimmer faceplate. The cover has a cover plate configured for engaging at least a portion of the sidewall of the skimmer faceplate; and at least a pair of closure members connected to opposing ends of the cover plate for locking the cover plate to the skimmer faceplate. Each of the closure members includes a body having a first end connected to the cover plate and a second end protruding relative to the first end, and a locking member having a first end connected to the second end of the body and a second end extending toward the first end of the body. The second end of the locking member is deflectable relative to the first end.

20 Claims, 8 Drawing Sheets

FLEXIBLE CLOSURE FOR SWIMMING POOL SKIMMER

BACKGROUND OF THE INVENTION

Field of the Invention

The present invention relates generally to swimming pools and, more particularly, to a sealing closure for closing a skimmer opening to prevent water from entering the skimmer when the swimming pool is closed for the season.

Brief Description of the Prior Art

It is common to employ one or more skimming devices in the sidewalls of swimming pools, hot tubs, and the like to permit surface water to be drawn off by a pump, to be filtered at a remote location and then optionally heated, and returned to the pool through one or more return ports. While the present disclosure focuses on skimming devices for swimming pools, it is to be understood that various other water structures, including, without limitation, hot tubs, spas, jet tubs, and the like can have similar or identical skimming devices. These skimming devices have a skimmer opening in a side wall of the pool for drawing the surface water to the pump. During normal use of the pool, the surface level of the water in the pool is at the same level as the skimmer opening such that water from the surface can enter the skimmer opening. When the pool is closed, for example during the winter season, it is sometimes desirable to maintain a lower level of water in the pool for structural purposes. Even if completely drained, the water level in the pool will naturally rise during the closed season due to rainwater and melting snow, such that the water level oftentimes rises to a level of the skimmer opening or above. In such cases, it is necessary to close off the skimmer opening to prevent backflow of water through the skimmer opening and the conduits that connect the skimmer opening to the filter, pump equipment, and heater so as to prevent damage to these components due to freezing.

Within the prior art, one way of closing the skimmer opening is to employ an elongated, plug-like element. The plug element is threadably secured within the floor of the skimmer body to seal the conduit communicating with the pump and filtration equipment. In other embodiments, a detachable cover plate or panel is removably attachable to the skimmer opening. Some of these existing devices require a retrofit of the skimmer faceplate in order to make sealing contact with a closure member. Other known devices require the use of a polymeric flexible sealing member which snaps over the skimmer opening. Such faceplate seals may lose their effectiveness due to weathering of the polymeric material, and also may require special retrofitting of the skimmer opening member to provide better sealing between the skimmer and the flexible snap-on faceplate. In addition, the existing faceplate seals may crack or be otherwise compromised due to temperature-related shirking and/or contact with ice. Furthermore, due to the conventional square or rectangular shape of the skimmer opening, the existing devices for closing the skimmer opening may not provide an adequate seal in the corners of such skimmer openings. Accordingly, there is a need in the art for an improved sealing closure for the skimmer opening that overcomes the deficiencies of the prior art.

SUMMARY OF THE INVENTION

In view of the existing need in the art, it would be desirable to develop a sealing closure assembly for a swimming pool skimmer opening that overcomes the deficiencies associated with the existing devices.

In accordance with some preferred and non-limiting embodiments or aspects of the present disclosure, provided is a sealing closure assembly for closing a skimmer opening of a swimming pool. The sealing closure assembly may include a skimmer faceplate having: a sidewall with a central opening shaped to correspond to the skimmer opening, a flange protruding from the sidewall to overlap a peripheral area of the skimmer opening, and a cover removably connectable to the skimmer faceplate to seal the central opening of the skimmer faceplate. The cover may include a cover plate configured for engaging at least a portion of the sidewall of the skimmer faceplate, and at least a pair of closure members connected to opposing ends of the cover plate for locking the cover plate to the skimmer faceplate. Each of the at least a pair of closure members may include a body having a first end connected to the cover plate and a second end protruding relative to the first end, and a locking member having a first end connected to the second end of the body and a second end extending toward the first end of the body. The second end of the locking member is deflectable relative to the first end of the locking member from a first, undeflected position to a second, deflected position with contact with the flange of the skimmer faceplate.

In accordance with some preferred and non-limiting embodiments or aspects of the present disclosure, a release tether may be provided, the release tether having a first end connected to a first of the at least a pair of closure members and a second end connected to a second of the at least a pair of closure members. The release tether may be movable from a first position to a second position. Movement of the release tether from the first position to the second position may cause the locking member to be deflected from the first, undeflected position to the second, deflected position.

In accordance with some preferred and non-limiting embodiments or aspects of the present disclosure, the locking member may be configured for engaging with the flange of the skimmer faceplate when the cover is connected to the skimmer faceplate. The second end of the locking member may include a notch protruding in a direction toward the flange of the skimmer faceplate. The notch may have a proximal edge that faces toward an inner surface of the cover plate and a distal edge that faces away from the inner surface of the cover plate. The proximal edge may be substantially parallel to a plane defined by the inner surface of the cover plate, and wherein the distal edge is angled relative to the plane. The notch may be spaced apart from an inner surface of the cover plate by a distance corresponding to a width of the flange of the skimmer faceplate In accordance with some preferred and non-limiting embodiments or aspects of the present disclosure, the body of each of the at least a pair of closure members may have a pair of beams spaced apart from each other and a cross beam connecting the pair of beams at the second end of the body. The first end of the locking member may be connected to the cross beam and wherein a body of the locking member extends between the pair of beams.

In accordance with some preferred and non-limiting embodiments or aspects of the present disclosure, a sealing gasket may extend around an inner surface of the cover plate and be configured for abutting the sidewall of the skimmer faceplate when the cover is connected to the skimmer faceplate.

In accordance with some preferred and non-limiting embodiments or aspects of the present disclosure, a cover element for closing a skimmer opening of a swimming pool skimmer may include a cover plate configured for engaging at least a portion of a sidewall of a skimmer faceplate, and at least a pair of closure members connected to opposing ends of the cover plate for locking the cover plate to the skimmer faceplate. Each of the at least a pair of closure members may include a body having a first end connected to the cover plate and a second end protruding relative to the first end, and a locking member having a first end connected to the second end of the body and a second end extending toward the first end of the body. The second end of the locking member is deflectable relative to the first end of the locking member from a first, undeflected position to a second, deflected position with contact with the flange of the skimmer faceplate.

In accordance with other preferred and non-limiting embodiments or aspects of the present disclosure, the sealing closure assembly may be defined by one or more of the following clauses:

Clause 1: A sealing closure assembly for closing a skimmer opening of a swimming pool, the sealing closure assembly comprising: a skimmer faceplate comprising: a sidewall with a central opening shaped to correspond to the skimmer opening; and a flange protruding from the sidewall to overlap a peripheral area of the skimmer opening, and a cover removably connectable to the skimmer faceplate to seal the central opening of the skimmer faceplate, the cover comprising: a cover plate configured for engaging at least a portion of the sidewall of the skimmer faceplate; and at least a pair of closure members connected to opposing ends of the cover plate for locking the cover plate to the skimmer faceplate, each of the at least a pair of closure members comprising: a body having a first end connected to the cover plate and a second end protruding relative to the first end; and a locking member having a first end connected to the second end of the body and a second end extending toward the first end of the body, wherein the second end of the locking member is deflectable relative to the first end of the locking member from a first, undeflected position to a second, deflected position with contact with the flange of the skimmer faceplate.

Clause 2: The sealing closure assembly of clause 1, further comprising a release tether having a first end connected to a first of the at least a pair of closure members and a second end connected to a second of the at least a pair of closure members.

Clause 3: The sealing closure assembly of clause 1 or 2, wherein the release tether is movable from a first position to a second position, and wherein movement of the release tether from the first position to the second position causes the locking member to be deflected from the first, undeflected position to the second, deflected position.

Clause 4: The sealing closure assembly of any of clauses 1 to 3, wherein the locking member is configured for engaging with the flange of the skimmer faceplate when the cover is connected to the skimmer faceplate.

Clause 5: The sealing closure assembly of any of clauses 1 to 4, wherein the second end of the locking member comprises a notch protruding in a direction toward the flange of the skimmer faceplate.

Clause 6: The sealing closure assembly of any of clauses 1 to 5, wherein the notch has a proximal edge that faces toward an inner surface of the cover plate and a distal edge that faces away from the inner surface of the cover plate.

Clause 7: The sealing closure assembly of any of clauses 1 to 6, wherein the proximal edge is substantially parallel to a plane defined by the inner surface of the cover plate, and wherein the distal edge is angled relative to the plane.

Clause 8: The sealing closure assembly of any of clauses 1 to 7, wherein the notch is spaced apart from an inner surface of the cover plate by a distance corresponding to a width of the flange of the skimmer faceplate.

Clause 9: The sealing closure assembly of any of clauses 1 to 8, wherein the body of each of the at least a pair of closure members has a pair of beams spaced apart from each other and a cross beam connecting the pair of beams at the second end of the body.

Clause 10: The sealing closure assembly of any of clauses 1 to 9, wherein the first end of the locking member is connected to the cross beam and wherein a body of the locking member extends between the pair of beams.

Clause 11: The sealing closure assembly of any of clauses 1 to 10, further comprising a sealing gasket extending around an inner surface of the cover plate and configured for abutting the sidewall of the skimmer faceplate when the cover is connected to the skimmer faceplate.

Clause 12: A cover element for closing a skimmer opening of a swimming pool skimmer, the cover element comprising: a cover plate configured for engaging at least a portion of a sidewall of a skimmer faceplate; and at least a pair of closure members connected to opposing ends of the cover plate for locking the cover plate to the skimmer faceplate, each of the at least a pair of closure members comprising: a body having a first end connected to the cover plate and a second end protruding relative to the first end; and a locking member having a first end connected to the second end of the body and a second end extending toward the first end of the body, wherein the second end of the locking member is deflectable relative to the first end of the locking member from a first, undeflected position to a second, deflected position with contact with the flange of the skimmer faceplate.

Clause 13: The cover element of clause 12, further comprising a release tether having a first end connected to a first of the at least a pair of closure members and a second end connected to a second of the at least a pair of closure members.

Clause 14: The cover element of clause 12 or 13, wherein the release tether is movable from a first position to a second position, and wherein movement of the release tether from the first position to the second position causes the locking member to be deflected from the first, undeflected position to the second, deflected position.

Clause 15: The cover element of any of clauses 12 to 14 wherein the locking member is configured for engaging with a flange of the skimmer faceplate when the cover is connected to the skimmer faceplate.

Clause 16: The cover element of any of clauses 12 to 15, wherein the second end of the locking member comprises a notch protruding in a direction toward the flange of the skimmer faceplate.

Clause 17: The cover element of any of clauses 12 to 16, wherein the notch has a proximal edge that faces toward an inner surface of the cover plate and a distal edge that faces away from the inner surface of the cover plate.

Clause 18: The cover element of any of clauses 12 to 17, wherein the proximal edge is substantially parallel to a plane defined by the inner surface of the cover plate, and wherein the distal edge is angled relative to the plane.

Clause 19: The cover element of any of clauses 12 to 18, wherein the notch is spaced apart from an inner surface of the cover plate by a distance corresponding to a width of a flange of the skimmer faceplate.

Clause 20: The cover element of any of clauses 12 to 19, wherein the body of each of the at least a pair of closure members has a pair of beams spaced apart from each other and a cross beam connecting the pair of beams at the second end of the body.

These and other features and characteristics of the present disclosure, as well as the methods of operation and functions of the related elements of structures and the combination of parts and economies of manufacture, will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

In FIGS. 1-12, the same characters represent the same components unless otherwise indicated.

DETAILED DESCRIPTION OF INVENTION

Figure 1:
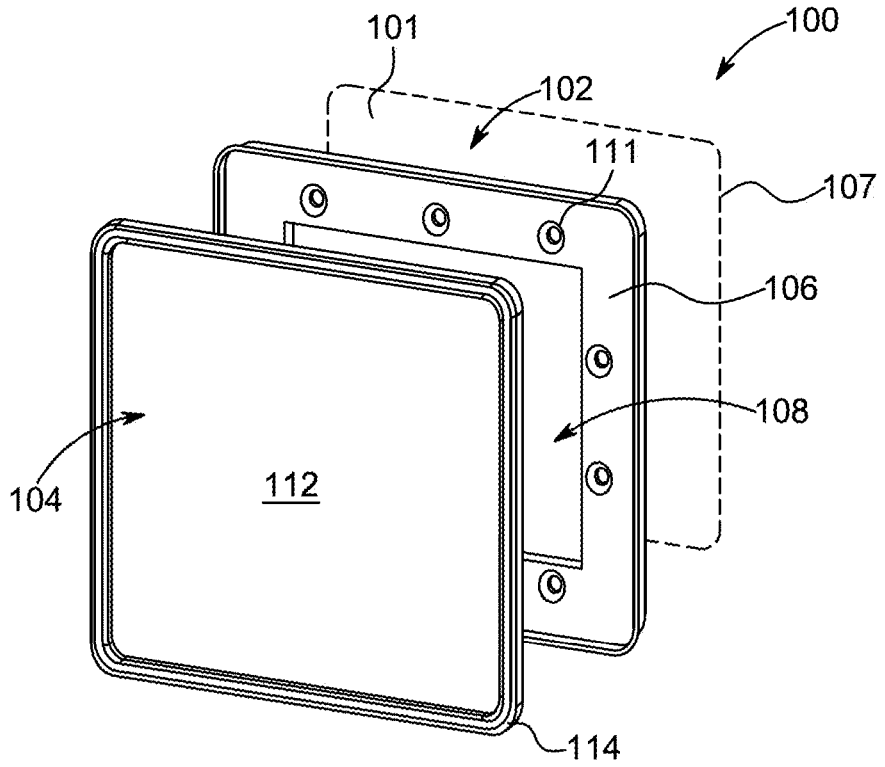
FIG. 1 is an exploded perspective view of a sealing closure assembly in accordance with some embodiments or aspects of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant within plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C.

The word "comprising" and "comprises", and the like, does not exclude the presence of elements or steps other than those listed in any claim or the specification as a whole. In the present specification, "comprises" means "includes" and "comprising" means "including".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular", "transverse", "substantially perpendicular", or "substantially transverse" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

With reference to FIG. 1, a sealing closure assembly 100 is configured for use with a skimmer (not shown) of a pool, spa, hot tub, or the like. The sealing closure 100 is configured to close a skimmer opening 101 on the swimming pool and prevent water from entering the skimmer opening 101. Typically, the skimmer is mounted on a pool sidewall. The skimmer has a peripheral flange 107 that defines the skimmer opening 101. The peripheral flange 107 may be secured to the pool sidewall by fasteners (not shown) or other mechanical means. Surface water from the pool is drawn through the skimmer opening 101 for subsequent pumping, filtration, and heating purposes. At least a portion of the sealing closure assembly 100 is configured to interact with the skimmer opening 101 so as to block the skimmer opening 101 and prevent the passage of water therethrough.

Figure 2:
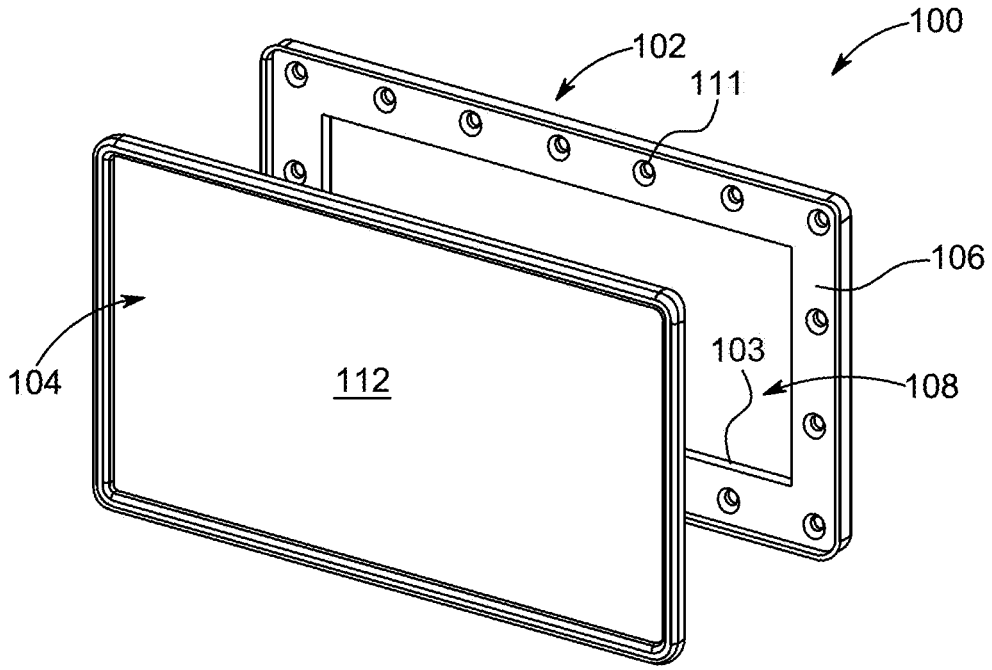
FIG. 2 is an exploded perspective view of a sealing closure assembly in accordance with some embodiments or aspects of the present disclosure.

With reference to FIGS. 1-2, the sealing closure assembly 100 includes a skimmer faceplate 102 and a cover 104 configured for removably connecting to the skimmer faceplate 102. The skimmer faceplate 102 is configured to be connected to the skimmer opening 101 on the pool or water side of the skimmer. The skimmer faceplate 102 has a generally square or rectangular shape, at least a portion of which is dimensioned to fit inside the skimmer opening 101. Desirably, an outer shape of at least a portion of the skimmer faceplate 102 is shaped to correspond to the shape of the skimmer opening 101. In some aspects, the skimmer faceplate 102 may be installed directly on the sidewall of the pool. In other aspects, the skimmer faceplate 102 may be installed over the skimmer peripheral flange 107.

Figure 3:
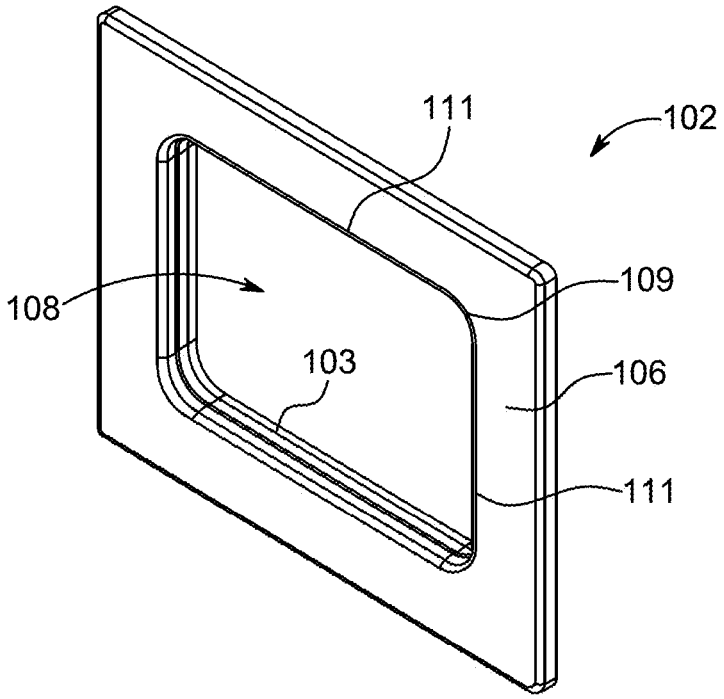
FIG. 3 is a front perspective view of a skimmer faceplate in accordance with some embodiments or aspects of the present disclosure.

With reference to FIG. 3, the skimmer faceplate 102 has a sidewall 106 defining an outer peripheral shape of the skimmer faceplate 102. The sidewall 106 has a central opening 108 with a flange 103 that extends around an inner periphery of the central opening 108 and protrudes rearwardly relative to the sidewall 106. In some aspects, at least a portion of the flange 103 may be inserted into the skimmer opening 101 such that the sidewall 106 overlaps at least a portion of the skimmer opening 101 in order to prevent movement of the skimmer faceplate 102 into the skimmer opening 101. In other aspects, at least a portion of the flange 103 may interact with the skimmer peripheral flange 107 (shown in FIG. 1) such that the sidewall 106 overlaps at least a portion of the skimmer opening 101 and/or the skimmer peripheral flange 107. In further examples, the flange 103 may narrow or widen in a direction from away from an outer surface of the sidewall 106 toward the skimmer opening 101. In other examples, the flange 103 may be substantially perpendicular to the sidewall 106.

With reference to FIGS. 1-2, in some embodiments or aspects, the sidewall 106 of the skimmer faceplate 102 may have one or more through-holes 111 configured to receive a fastener element (not shown), such as a screw, to connect the skimmer faceplate 102 to the skimmer opening 101 and/or the skimmer peripheral flange 107. In further embodiments or aspects, the skimmer faceplate 102 may be connected to the skimmer opening 101 and/or the skimmer peripheral flange 107 by an adhesive. The underside of the skimmer faceplate 102 could have several undercut notched areas (not shown) formed therein to permit the insertion of a removal tool, such as a screwdriver tip, to permit removal of the skimmer faceplate 102 from the skimmer opening 101 and the skimmer peripheral flange 107, if desired.

Figure 4:
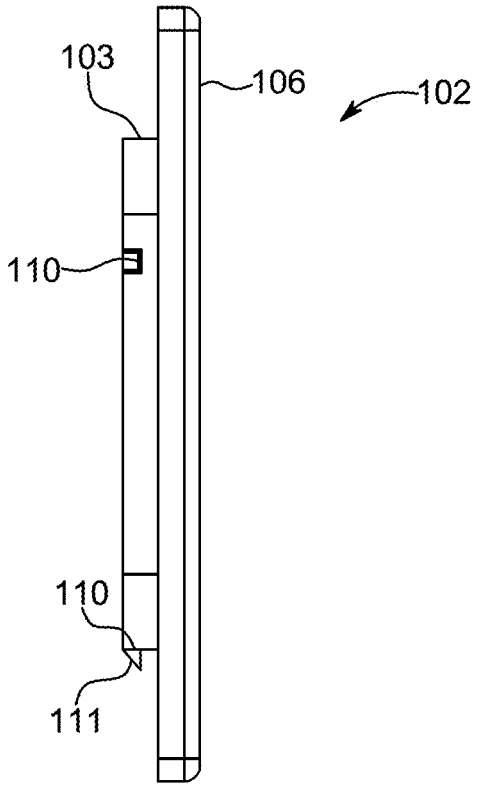
FIG. 4 is a side view of the skimmer faceplate shown in FIG. 3.

The skimmer faceplate 102 may be removably or non-removably connected to the skimmer opening 101 and/or the skimmer peripheral flange 107. With specific reference to FIGS. 4 and 6, in some embodiments or aspects, the flange 103 of the skimmer faceplate 102 has one or more locking elements 110 configured to connect with the skimmer peripheral flange (not shown) installed around the skimmer opening 101. The one or more locking elements 110 may be formed at an outer periphery of the flange 103. In some embodiments or aspects, the one or more locking elements 110 may formed as tabs that snap over the skimmer peripheral flange installed around the skimmer opening 101. At least a portion of the flange 103 may be flexible to allow the one or more locking elements 110 to be deflected such that they can pass over the skimmer peripheral flange. Alternatively, the flange 103 may be rigid, while the one or more locking elements 110 may flex or deflect relative to the flange 103 to allow the skimmer faceplate 102 to be connected to the skimmer peripheral flange installed around the skimmer opening 101. In some embodiments or aspects, the flange 103 and/or the one or more locking elements 110 may be movable between a first, undeflected position and a second, deflected position. Once the one or more locking elements 110 clear the skimmer peripheral flange, the one or more locking elements 110 may snap back to the initial, undeflected position. One of ordinary skill in the art will appreciate that the one or more locking elements 110 may be formed as tabs, snaps, or other fastening elements that connect the skimmer faceplate 102 to the skimmer peripheral flange 107.

Figure 5:
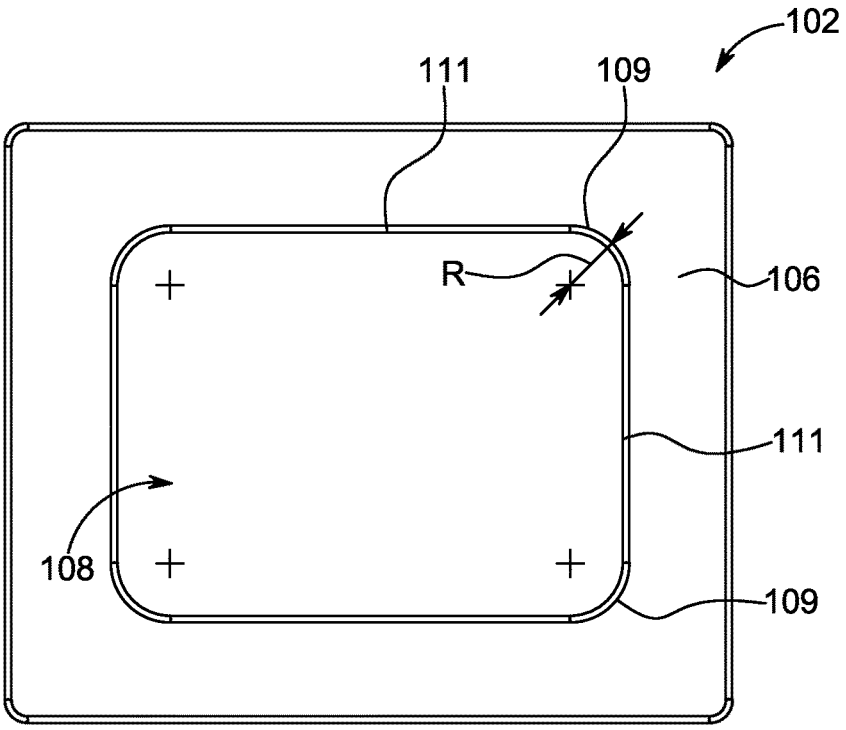
FIG. 5 is a front view of the skimmer faceplate shown in FIG. 3.
Figure 6:
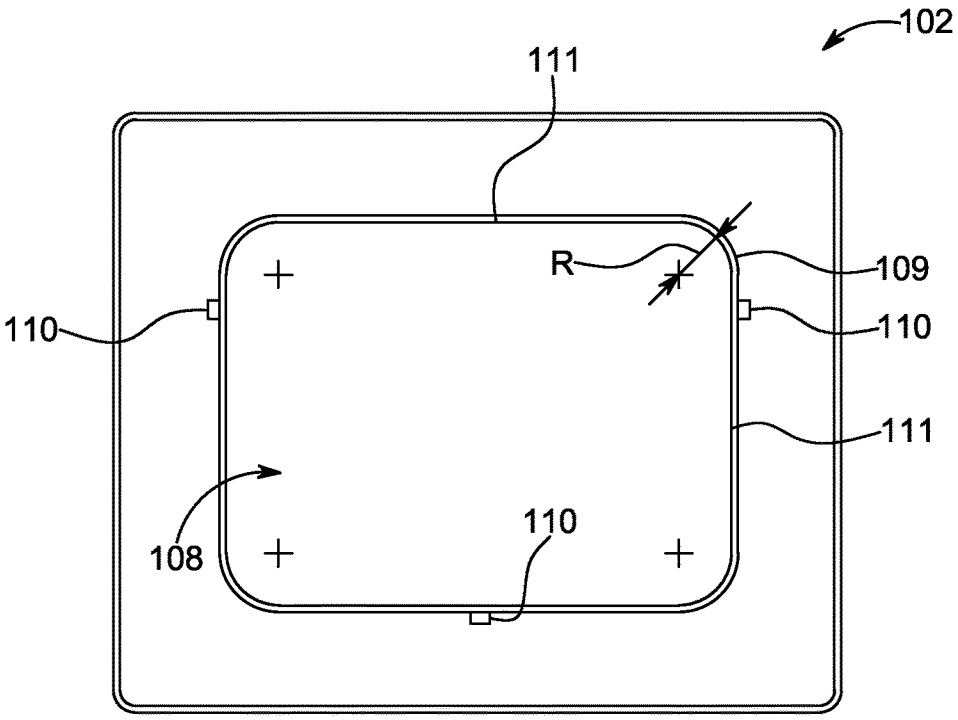
FIG. 6 is a rear view of the skimmer faceplate shown in FIG. 3.

With reference to FIGS. 5-6, the skimmer faceplate 102 may have one or more radiused corners 109 at apex locations of the central opening 108. In some aspects, the radiused corners 109 may be provided to ease the transition between the adjoining linear or substantially linear portions 111 of the skimmer faceplate 102 to provide a better sealing interface with the sealing gasket of the cover 104, as described herein. For example, the radiused corners 109 may have a radius R between 0.25" to 1" and may join to linear or substantially linear portions that are oriented at a substantially perpendicular angle. In this manner, the radiused corners 109 provide a smooth transition between the adjoining linear or substantially portions 111 in the corners of the central opening 108 to prevent leakage of water.

In some embodiments or aspects, the skimmer faceplate 102 is formed as a one-piece integral member formed from a rigid material. For example, the skimmer faceplate 102 may be injection molded from a hard plastic material, such as an ABS plastic resin that resists dimensional shrinking due to temperature variations. In other aspects, the skimmer faceplate 102 may be formed from metal, composite material, such as carbon fiber, or a combination of metal, plastic, and/or composite materials. In various aspects, the skimmer faceplate 102 is made from a rigid material capable of resisting stretching or breaking due to contact with ice which may form in the pool.

With reference to FIGS. 1-2, the cover 104 is configured to be removably secured to the skimmer faceplate 102 to enclose the central opening 108 and prevent passage of water through the central opening 108 and into the skimmer opening 101. In some embodiments or aspects, the cover 104 is formed as a one-piece integral member formed from a rigid material. For example, the cover 104 may be injection molded from a hard plastic material, such as an ABS plastic resin that resists dimensional shrinking due to temperature variations. In other aspects, the cover 104 may be formed from metal, composite material, such as carbon fiber, or a combination of metal, plastic, and/or composite materials. In various aspects, the cover 104 is made from a rigid material capable of resisting stretching or breaking due to contact with ice which may form in the pool.

Figure 7:
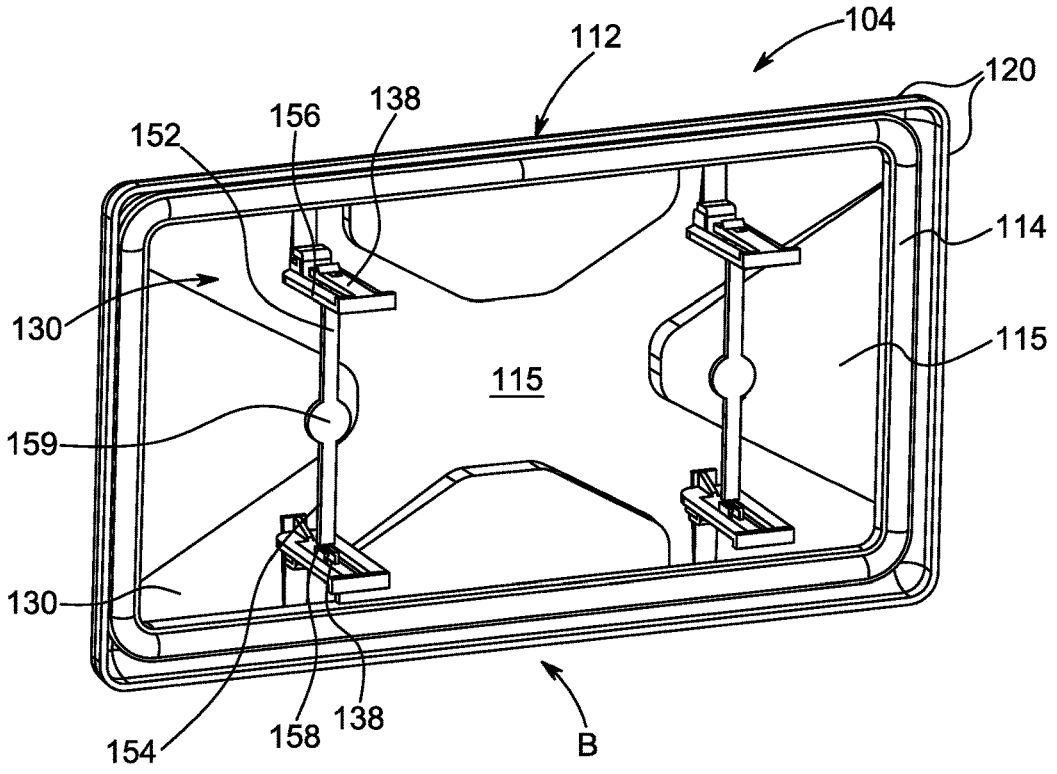
FIG. 7 is a rear view of a flexible closure for swimming pool skimmer in accordance with some embodiments or aspects of the present disclosure.
Figure 12:
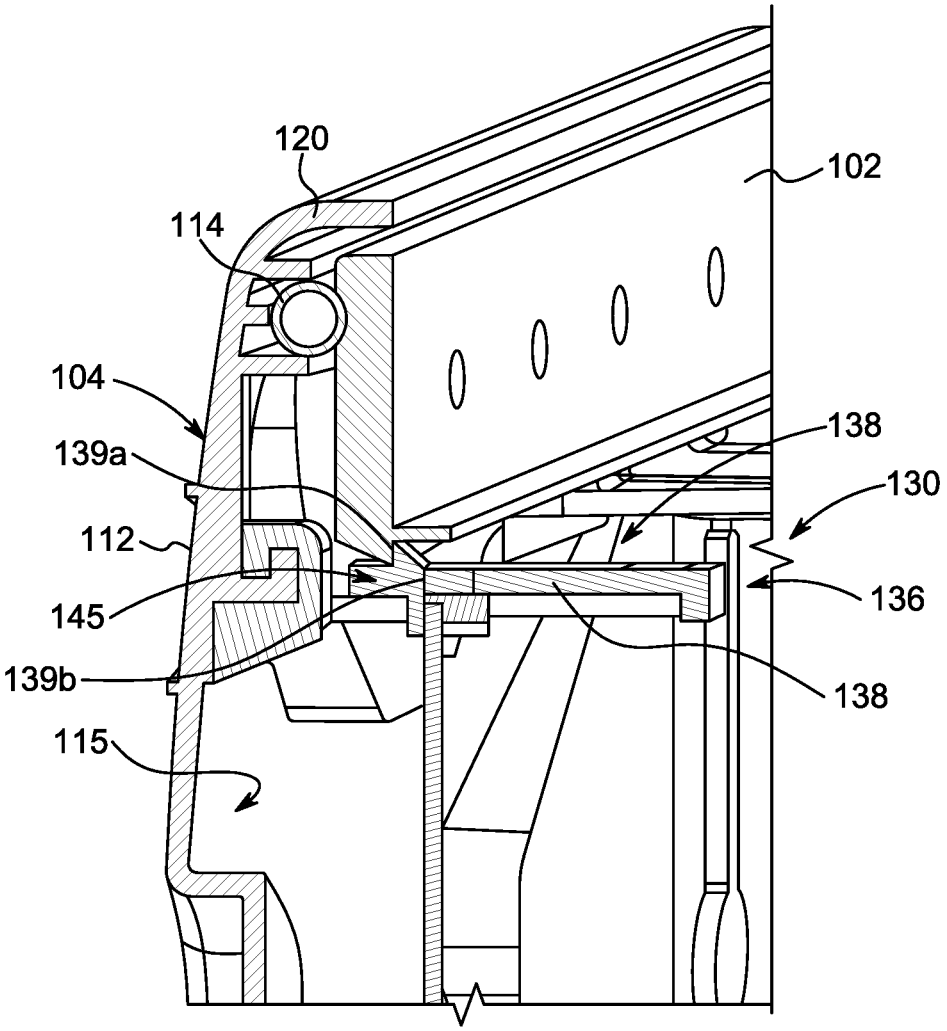
FIG. 12 is an enlarged detail view of a portion of the cover and the skimmer faceplate shown in FIG. 11.

With reference to FIG. 7, the cover 104 has a cover plate 112 that is shaped to correspond to the central opening 108 of the skimmer faceplate 102 (see also FIGS. 1-2). A sealing gasket 114 extends around an inner surface 115 of the cover plate 112. The cover plate 112, together with the sealing gasket 114, is configured to abut the outer surface of the sidewall 106 of the skimmer faceplate 102. For example, the cover plate 112 may be configured to interface with the skimmer faceplate 102, such that the sealing gasket 114 contacts the outer or pool-side facing surface of the sidewall 106 for a watertight seal between the cover plate 112 and the skimmer faceplate 102 (see FIG. 12).

With reference to FIG. 7, the sealing gasket 114 of the cover 104 may be dimensioned such that the sealing gasket 114 has a shape that corresponds to the shape of the sidewall 106 of the skimmer faceplate 102. That is, the sealing gasket 114 of the cover 104 may have one or more linear or substantially linear portions that correspond to the one or more linear or substantially linear portions 111 of the skimmer faceplate 102 and one or more radiused portions with a radius that substantially corresponds to the radius R of the radiused corners 109 of the skimmer faceplate 102. The sealing gasket 114 may be a monolithic component, or it may be comprised of two or more separate elements. In some aspects, the sealing gasket 114 is formed separately from the cover plate 112 and is removably or non-removably installed on the cover plate 112. In other aspects, the sealing gasket 114 is formed together with the cover plate 112, such as by co-molding. In some aspects, the sealing gasket 114 may be formed from a resilient material, such as a thermoplastic elastomer, which remains flexible in varying temperature settings and is resistant to degradation over time. The sealing gasket 114 may be formed, for example, by injection molding, or, as noted above, by co-molding with the cover plate 112.

With continued reference to FIG. 7, the cover 104 has a lip 120 protruding from the inner surface 115 of the cover plate 112. The lip 120 is shaped to correspond to the shape of an outer periphery of the skimmer faceplate 102. When the cover 104 is installed on the skimmer faceplate 102, the lip 120 may be configured to conceal the skimmer faceplate 102 (see FIG. 10).

With continued reference to FIG. 7, the cover 104 has at least one closure member 130 on the cover plate 112 for locking the cover plate 112 to the skimmer faceplate 102. As described herein, the at least one closure member 130 is positioned such that it is configured to interface with at least a portion of the skimmer faceplate 102. When the at least one closure member 130 is connected to the skimmer faceplate 102, the cover 104 is locked to the skimmer faceplate 102 to prevent ingress of water into the skimmer opening.

In some embodiments or aspects, the at least one closure member 130 is four closure members 130 positioned to engage four separate locations, such as four corners, of the flange 103 of the skimmer faceplate 102. The bodies 132 of the closure members 130 may be spaced apart from each other by a distance corresponding to a width and height of the central opening 108 of the skimmer faceplate 108.

Figure 8:
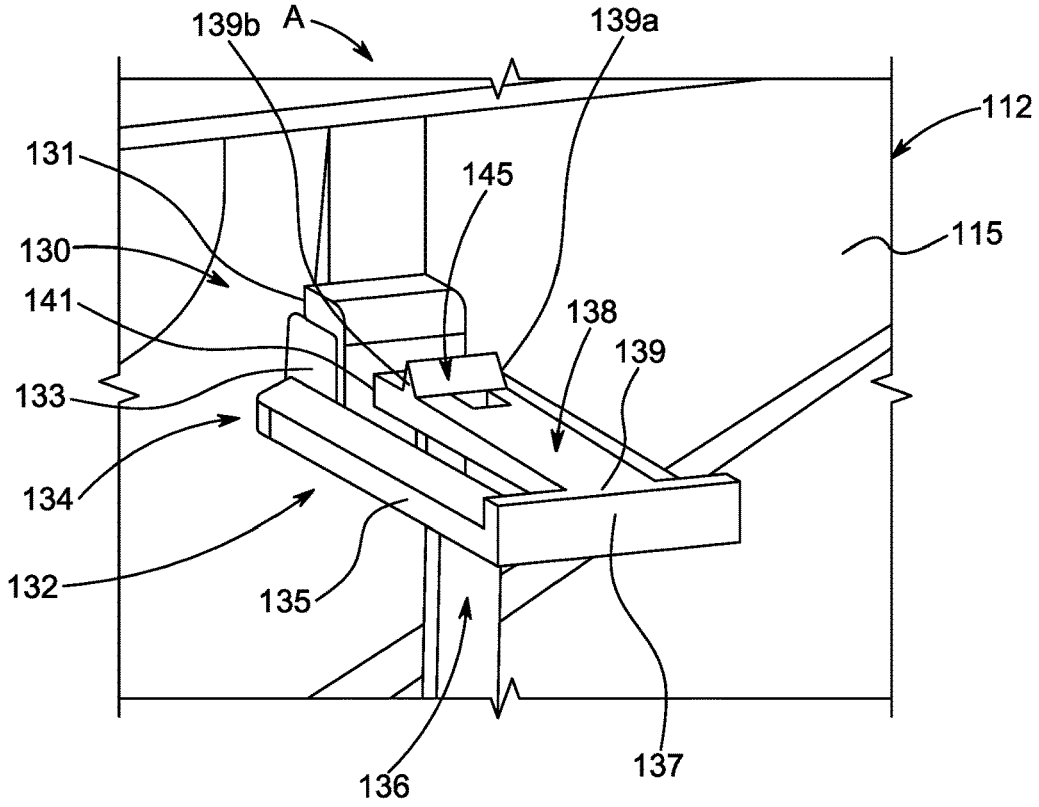
FIG. 8 is an enlarged detail view of a portion of the cover shown in FIG. 7.

The at least one closure member 130 may be removably or non-removably connected to the cover plate 112. In some embodiments or aspects, and as shown in FIG. 8, the at least one closure member 130 may have a clip 131 that is removably connectable to a tab 133 on the cover plate 112. In other embodiments or aspects, the at least one closure member 130 may be monolithically formed with the cover plate 112.

With reference to FIG. 8, the at least one closure member 130 includes a body 132 having a first end 134 connected to the cover plate 112 and a second end 136 protruding relative to the first end 134. In some embodiments or aspects, the body 132 of the at least one closure member 130 may protrude in a direction substantially perpendicular to a plane defined by the cover plate 112. The body 132 may have a pair of beams 135 spaced apart from each other with a cross beam 137 connecting the pair of beams 135 at the second end 136 of the at least one closure member 130.

With continued reference to FIG. 8, the at least one closure member 130 has a locking member 138 between the first end 134 and the second end 136. In some embodiments or aspects, the locking member 138 may be connected to the cross beam 137 at the second end 136 of the at least one closure member 130 and extend in a direction toward the first end 134. The locking member 138 may be positioned between the pair of beams 135. The locking member 138 is configured for engaging with the flange 103 of the skimmer faceplate 102 when the cover 104 is connected to the skimmer faceplate 102.

The locking member 138 has a first end 139 connected to the second end 136 of the at least one closure member 130, such as the cross beam 137 at the second end of the at least one closure member 130. The locking member 138 further has a second end 141 protruding relative to the first end 139 in a direction toward the first end 134 of the closure member 130. The second end 141 of the locking member 138 is deflectable relative to the first end 139. For example, the second end 141 of the locking member 138 may be resiliently deflectable relative to the first end 139 in a direction of arrow A such that the second end 141 reverts back to its initial position after being laterally displaced relative to the first end 139. The second end 141 of the locking member 138 is also deflectable relative to the pair of beams 135 of the at least one closure member 130.

In some embodiments or aspects, the second end 141 of the locking member 138 has a notch 145 that protrudes in a direction toward the nearest wall of the skimmer faceplate 102 when the cover 102 is in a position to be installed on the skimmer faceplate 102. The notch 145 has a proximal edge **139*a* that faces the inner surface of the cover plate 112 and a distal edge 139*b* that faces away from the inner surface of the cover plate 112. In some embodiments or aspects, the proximal edge 139*a* may be substantially parallel to a plane defined by the cover plate 112, while the distal edge 139*b* may be angled relative to the plane of the cover plate 112. The notch 145 is spaced apart from the first end 134 of the at least one closure member 130 by a distance corresponding to a thickness of the flange 103 of the skimmer faceplate 102. In this manner, when the at least one closure member 130 is connected to the skimmer faceplate 102, the flange 103 of the skimmer faceplate 102 is captured between the first end 134 and the notch 145**.

With reference to FIG. 7, the closure member 130 has a release tether 150 configured for facilitating release of the locking member 138 from the skimmer faceplate 102. The release tether 150 has a first end 152 connected to a first of a pair of opposing closure members 130 and a second end 154 connected to a second of the pair of opposing closure members 130. In some embodiments or aspects, the release tether 150 is connected to the locking member 138 of each of the pair of opposing closure members 130. For example, the first end 152 of the release tether 150 may be connected to the first of the opposing pair of closure members 130 at a first connection point 156 between the first and second ends 139, 141 of the locking member 138. Similarly, the second end 154 of the release tether 150 may be connected to the second of the opposing pair of closure members 130 at a second connection point 158 between the first and second ends 139, 141 of the locking member 138.

With continued reference to FIG. 7, the release tether 150 is configured to move from a first positon to a second position via a pressing movement in a direction of arrow B. With such pressing movement, a middle portion 159 of the release tether 150 is moved toward the inner surface of the cover plate 112 while the first and second ends 152, 154 of the release tether 150 pull on the locking members 130 of the opposing pair of closure members 130 to deflect the locking members 130 from a first, undeflected position to a second, deflected position. In the second, deflected position, the notches 145 of the locking members 138 are positioned away from the flange 103 of the skimmer faceplate 102 to facilitate release of the cover 104 from the skimmer faceplate 102.

In some embodiments or aspects, a pair of release tethers 150 is provided. Each release tether 150 connects an opposing pair of closure members 138 such that notches 145 of the locking members 138 are movable toward each other with a pressing movement on the middle portion 159 of the release tether 150 in the direction of arrow B. In this manner, a single release tether 150 is configured to release a pair of opposing locking members 138 from one side of the skimmer faceplate 102.

Having described the structure of the sealing closure assembly 100, a method of installing the sealing closure assembly 100 to close the skimmer opening 101 and prevent the passage of water into the skimmer opening 101 will now be described, along with a method for removing the sealing closure assembly 100 from the skimmer opening 101.

To install the sealing closure assembly 100, the skimmer faceplate 102 is first installed on the skimmer opening 101, for example by snapping the skimmer faceplate 102 such that the one or more locking elements 110 lockingly engage the skimmer faceplate 102 with the skimmer peripheral flange 107. In various other aspects, the skimmer faceplate 102 may be installed on the skimmer peripheral flange 107 by one or more fasteners, adhesive, or any other mechanical connection means that securely retains the skimmer faceplate 102 on the skimmer peripheral flange 107. When installed, the skimmer faceplate 102 surrounds the skimmer opening 101 such that obstructing the central opening 108 of the skimmer faceplate 102 also obstructs the skimmer opening 101.

Figure 9:
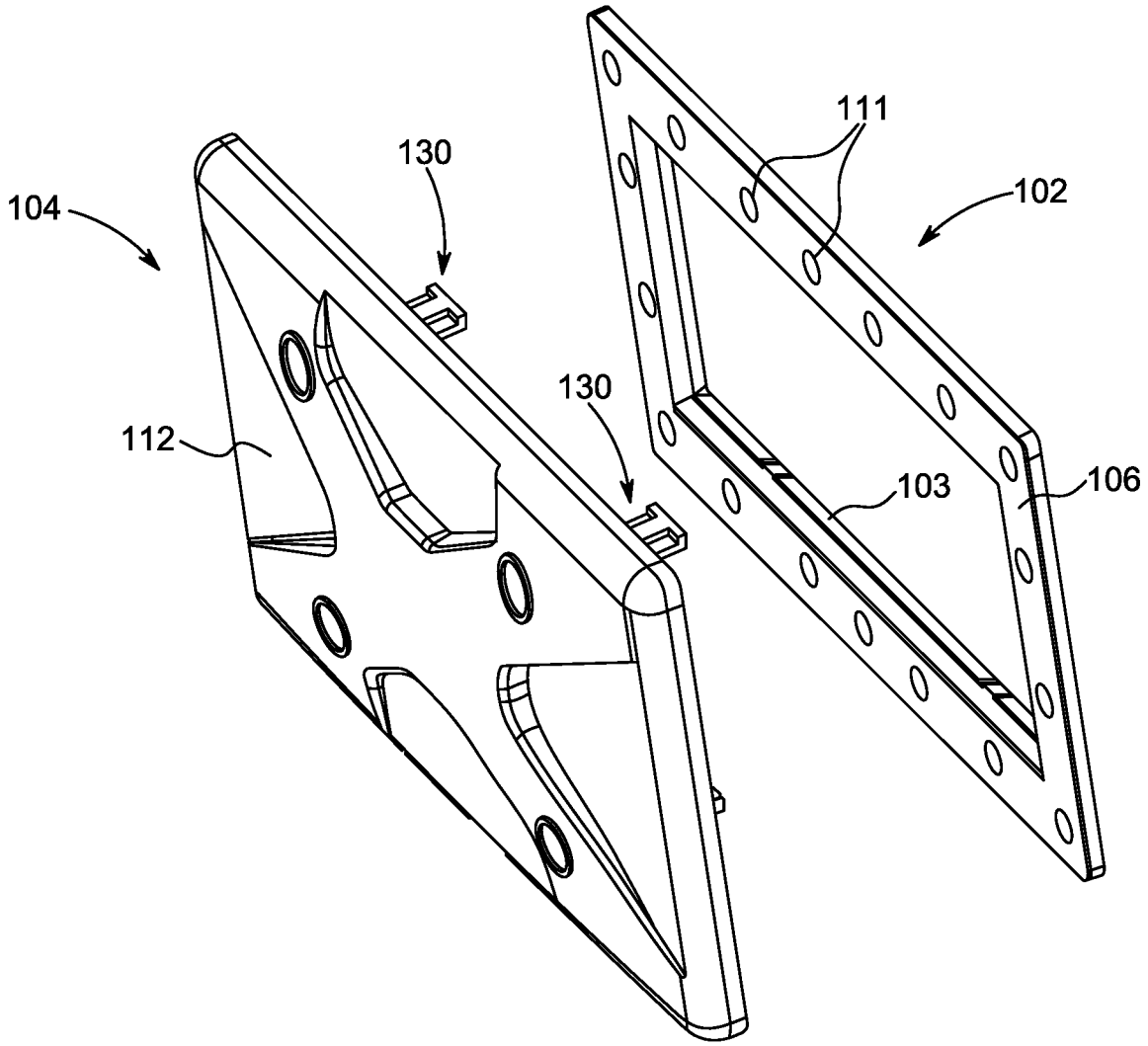
FIG. 9 is an exploded perspective view of the closure shown in FIG. 7 and a skimmer faceplate.
Figure 10:
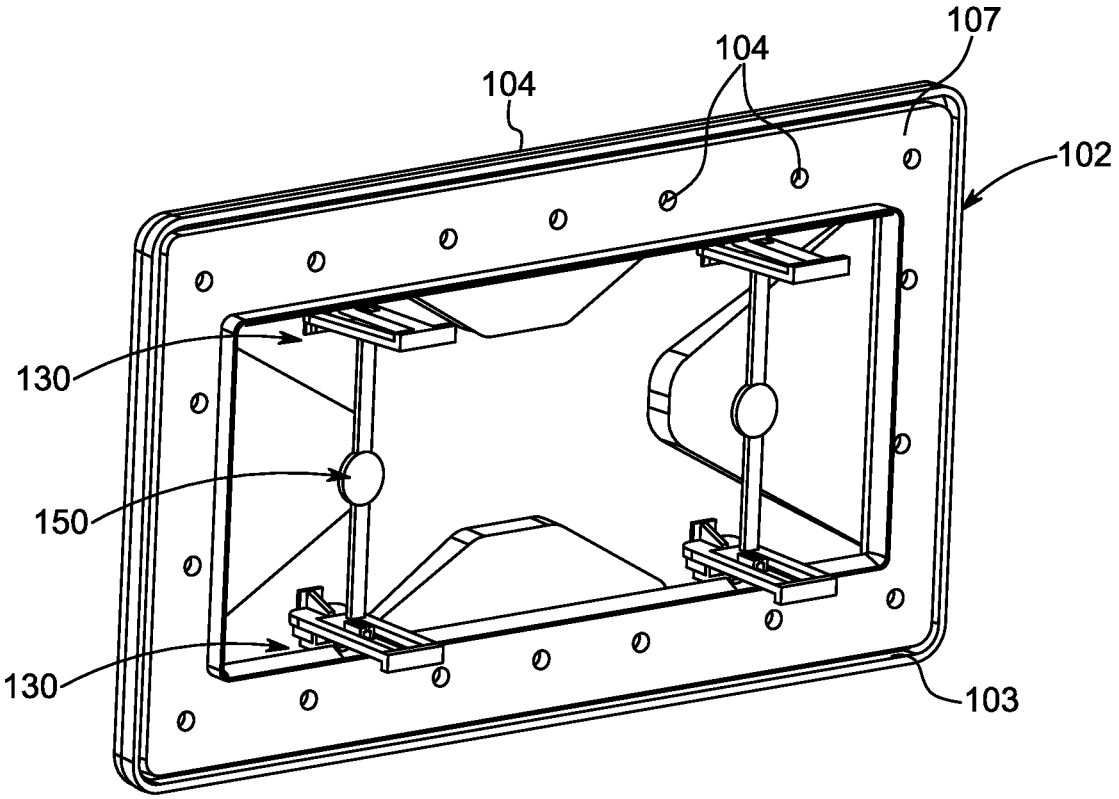
FIG. 10 is a rear perspective view of the cover connected to the skimmer faceplate shown in FIG. 9.

Next, and with reference to FIG. 9, the cover 104 is connected to the skimmer faceplate 102 by aligning the cover 104 with the opening of the skimmer faceplate 102 and pushing the cover 104 toward the skimmer faceplate 102 such that the closure members 130 engage the flange 103 of the skimmer faceplate 102. Specifically, with movement of the cover 104 in a direction of arrow C shown in FIG. 9, the proximal edge 139*a* of each notch 145 (shown in FIG. 8) engages the flange 103 such that the second ends 141 of the locking members 138 on the cover 104 are directed away from the flange 103 from an initial position to a deflected position. With continued movement of the cover 104 toward the skimmer faceplate 102 in the direction of arrow C, the distal edges 139*b* of each notch 145 pass over the flange 103 of the skimmer faceplate 102 such that the skimmer faceplate 102 is captured between the proximal edge 139*a* and the inner surface of the cover plate 112 (see FIGS. 11-12). In this position, the second end 141 of each locking member 138 is deflected from the deflected position back to the initial, undeflected position or to a partially deflected position (FIG. 10). Furthermore, the sealing gasket 114 contacts the outer surface of the skimmer faceplate 102 to seal the interface between the cover plate 112 and the skimmer faceplate 102. In this manner, the cover 104 is securely fastened to the skimmer faceplate 102 and ingress of water into the central opening 108 of the skimmer faceplate 102 and into the skimmer opening is prevented.

Figure 11:
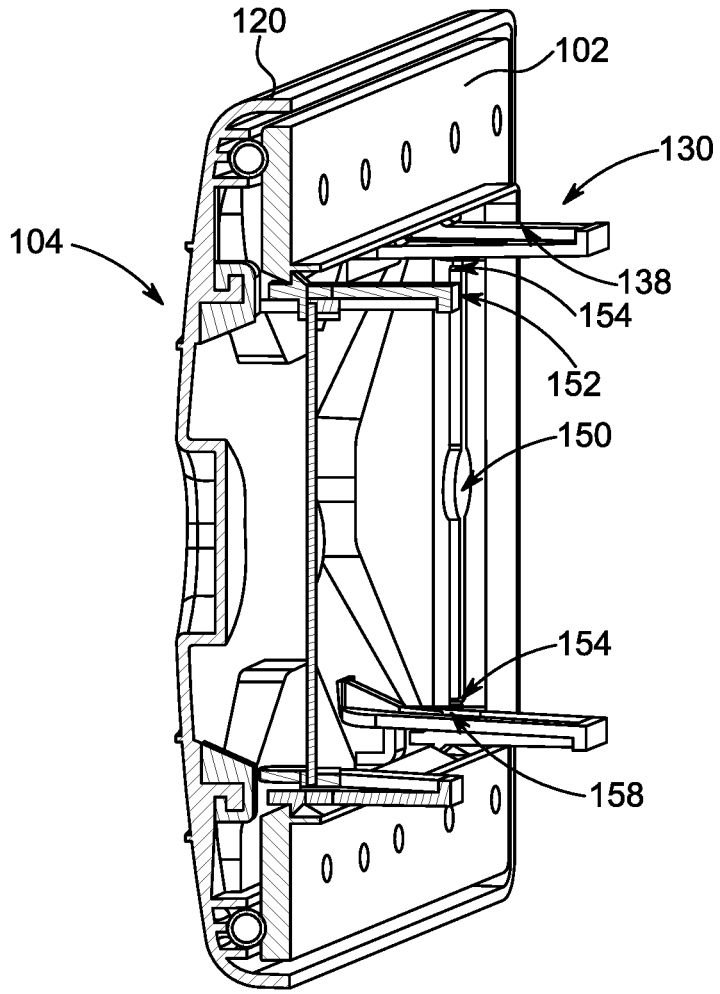
FIG. 11 is a side cross-sectional view of the interaction between the cover and the skimmer faceplate shown in FIG. 10.

With reference to FIG. 11, to remove the cover 104 from the skimmer faceplate 102, the user pushes on the release tethers 150 in a direction of arrow B. The release tethers 150 may be accessed through a skimmer opening on the pool deck. With such pushing movement, a middle portion 158 of the release tether 150 is moved toward the inner surface of the cover plate 112 while the first and second ends 152, 154 of the release tether 150 pull on the locking members 130 of the opposing pair of closure members 130 to deflect the locking members 130 from a first, undeflected position to a second, deflected position. By pushing the release tethers 150 in the direction of arrow B, the first and second ends 152, 154 of each release tether 150 pull the second ends 141 of the locking members 138 away from the flange 103 of the skimmer faceplate 102. This allows the proximal edges 139*a* of each notch 145 to be moved away from the flange 103 to allow the notch 145 to pass over the flange 103 of the skimmer faceplate 102 such that the cover 104 can moved in a direction away from the skimmer faceplate 102.

While specific embodiments or aspects of the invention have been described in detail, it will be appreciated by those skilled in the art that various modifications and alternatives to those details could be developed in light of the overall teachings of the disclosure. The presently preferred embodiments or aspects described herein are meant to be illustrative only and not limiting as to the scope of the invention which is to be given the full breadth of the appended claims and any and all equivalents thereof.

The invention claimed is:

1. A sealing closure assembly for closing a skimmer opening of a swimming pool, the sealing closure assembly comprising:
- a skimmer faceplate comprising:
  - a sidewall with a central opening shaped to correspond to the skimmer opening; and
  - a flange protruding from the sidewall to overlap a peripheral area of the skimmer opening, and
- a cover removably connectable to the skimmer faceplate to seal the central opening of the skimmer faceplate, the cover comprising:
  - a cover plate configured for engaging at least a portion of the sidewall of the skimmer faceplate; and
  - at least a pair of closure members connected to opposing ends of the cover plate for locking the cover plate to the skimmer faceplate, each of the at least a pair of closure members comprising:
    - a body having a first end connected to the cover plate and a second end protruding relative to the first end; and
    - a locking member having a first end connected to the second end of the body and a second end extending toward the first end of the body,
- wherein the second end of the locking member is deflectable relative to the first end of the locking member from a first, undeflected position to a second, deflected position with contact with the flange of the skimmer faceplate.

2. The sealing closure assembly of claim 1, further comprising a release tether having a first end connected to a first of the at least a pair of closure members and a second end connected to a second of the at least a pair of closure members.

3. The sealing closure assembly of claim 2, wherein the release tether is movable from a first position to a second position, and wherein movement of the release tether from the first position to the second position causes the locking member to be deflected from the first, undeflected position to the second, deflected position.

4. The sealing closure assembly of claim 1, wherein the locking member is configured for engaging with the flange of the skimmer faceplate when the cover is connected to the skimmer faceplate.

5. The sealing closure assembly of claim 1, wherein the second end of the locking member comprises a notch protruding in a direction toward the flange of the skimmer faceplate.

6. The sealing closure assembly of claim 5, wherein the notch has a proximal edge that faces toward an inner surface of the cover plate and a distal edge that faces away from the inner surface of the cover plate.

7. The sealing closure assembly of claim 6, wherein the proximal edge is substantially parallel to a plane defined by the inner surface of the cover plate, and wherein the distal edge is angled relative to the plane.

8. The sealing closure assembly of claim 5, wherein the notch is spaced apart from an inner surface of the cover plate by a distance corresponding to a width of the flange of the skimmer faceplate.

9. The sealing closure assembly of claim 1, wherein the body of each of the at least a pair of closure members has a pair of beams spaced apart from each other and a cross beam connecting the pair of beams at the second end of the body.

10. The sealing closure assembly of claim 9, wherein the first end of the locking member is connected to the cross beam and wherein a body of the locking member extends between the pair of beams.

11. The sealing closure assembly of claim 1, further comprising a sealing gasket extending around an inner surface of the cover plate and configured for abutting the sidewall of the skimmer faceplate when the cover is connected to the skimmer faceplate.

12. A cover element for closing a skimmer opening of a swimming pool skimmer, the cover element comprising:

a cover plate configured for engaging at least a portion of a sidewall of a skimmer faceplate; and at least a pair of closure members connected to opposing ends of the cover plate for locking the cover plate to the skimmer faceplate, each of the at least a pair of closure members comprising:

a body having a first end connected to the cover plate and a second end protruding relative to the first end; and a locking member having a first end connected to the second end of the body and a second end extending toward the first end of the body, wherein the second end of the locking member is deflectable relative to the first end of the locking member from a first, undeflected position to a second, deflected position with contact with the flange of the skimmer faceplate.

13. The cover element of claim 12, further comprising a release tether having a first end connected to a first of the at least a pair of closure members and a second end connected to a second of the at least a pair of closure members.

14. The cover element of claim 13, wherein the release tether is movable from a first position to a second position, and wherein movement of the release tether from the first position to the second position causes the locking member to be deflected from the first, undeflected position to the second, deflected position.

15. The cover element of claim 12, wherein the locking member is configured for engaging with a flange of the skimmer faceplate when the cover is connected to the skimmer faceplate.

16. The cover element of claim 12, wherein the second end of the locking member comprises a notch protruding in a direction toward the flange of the skimmer faceplate.

17. The cover element of claim 16, wherein the notch has a proximal edge that faces toward an inner surface of the cover plate and a distal edge that faces away from the inner surface of the cover plate.

18. The cover element of claim 17, wherein the proximal edge is substantially parallel to a plane defined by the inner surface of the cover plate, and wherein the distal edge is angled relative to the plane.

19. The cover element of claim 16, wherein the notch is spaced apart from an inner surface of the cover plate by a distance corresponding to a width of a flange of the skimmer faceplate.

20. The cover element of claim 12, wherein the body of each of the at least a pair of closure members has a pair of beams spaced apart from each other and a cross beam connecting the pair of beams at the second end of the body.

* * * * *